US005826995A

United States Patent [19]

Day et al.

[11] Patent Number: 5,826,995

[45] Date of Patent: Oct. 27, 1998

[54] CASSETTE FOR A THERMAL PRINTER

[75] Inventors: Robert Charles Lewis Day, Cambridge; Richard William Ware, Welwyn Garden City, both of United Kingdom

[73] Assignee: Esselte N.V., St. Niklaas, Belgium

[21] Appl. No.: 810,789

[22] Filed: Mar. 5, 1997

Related U.S. Application Data

[62] Division of Ser. No. 470,657, Jun. 6, 1995, Pat. No. 5,658,083, which is a continuation of Ser. No. 266,828, Jun. 27, 1994.

[30] Foreign Application Priority Data

Jul. 12, 1993 [GB] United Kingdom ..... 9314386

[51] Int. Cl.[6] ..... B41J 15/04

[52] U.S. Cl. ..... 400/615.2; 400/586; 400/611; 400/634

[58] Field of Search ..... 400/586, 615.2, 400/621, 634, 611

[56] References Cited

U.S. PATENT DOCUMENTS

| | | | |
|---|---|---|---|
| 1,742,295 | 1/1930 | Young . | |
| 2,185,885 | 1/1940 | Bruker et al. | 83/176 X |
| 2,372,020 | 3/1945 | Sandberg | 83/176 X |
| 3,423,984 | 1/1969 | Keymer | 72/338 |
| 3,435,717 | 4/1969 | Macomber | 83/176 |
| 3,530,028 | 9/1970 | Messmer | 156/584 |
| 3,533,616 | 10/1970 | Bettenhausen | 83/175 X |
| 3,755,049 | 8/1973 | Leloux | 156/584 |
| 3,902,954 | 9/1975 | Lotto | 83/175 |
| 4,173,507 | 11/1979 | Tobey | 156/584 X |
| 4,250,780 | 2/1981 | Shimizu | 81/176 |
| 4,685,991 | 8/1987 | Herrmann et al. | 156/344 |
| 4,764,243 | 8/1988 | Shiori et al. | 156/505 |
| 5,022,771 | 6/1991 | Pague | 400/621 |
| 5,066,152 | 11/1991 | Kuzuya et al. | 400/621 |
| 5,188,469 | 2/1993 | Nagaa et al. | 400/621 |
| 5,209,151 | 5/1993 | Takagi et al. | 400/621 |
| 5,224,786 | 7/1993 | Takagi et al. | 400/621 |
| 5,259,681 | 11/1993 | Kitazawa et al. | 400/621 |
| 5,271,789 | 12/1993 | Takagi et al. | 400/621 |
| 5,658,083 | 8/1997 | Day et al. | 400/621 |

FOREIGN PATENT DOCUMENTS

| | | |
|---|---|---|
| 0077127A3 | 4/1983 | European Pat. Off. . |
| 0 113 701 | 1/1984 | European Pat. Off. . |
| 0214461A2 | 3/1987 | European Pat. Off. . |
| 0215397A2 | 3/1987 | European Pat. Off. . |
| 0 327 075 | 1/1989 | European Pat. Off. . |
| 0319209 | 6/1989 | European Pat. Off. . |
| 0 488 998 A2 | 10/1989 | European Pat. Off. . |
| 0506257A1 | 9/1992 | European Pat. Off. . |
| 056213A2 | 2/1993 | European Pat. Off. . |
| 0 567 299 A1 | 4/1993 | European Pat. Off. . |
| 1173784 | 7/1964 | Germany . |
| 3730810A3 | 3/1989 | Germany . |
| 2008028 | 5/1979 | United Kingdom . |
| WO89/10888 | 11/1989 | WIPO . |

*Primary Examiner*—John S. Hilten
*Attorney, Agent, or Firm*—Pennie & Edmonds LLP

[57] ABSTRACT

A tape holding case is described for use with a thermal printing device which allows for more efficient cutting and feeding of tape. The cassette has a slot into which a cutting blade can pass which avoids the use of an anvil for cutting. Moreover, the cassette can have a stepped portion for providing a so-called "peel cut" at the end of the tape.

7 Claims, 4 Drawing Sheets

CASSETTE FOR A THERMAL PRINTER

This is a division of application No. 08/470,657, filed Jun. 6, 1995, now U.S. Pat. No. 5,658,083, which is a continuation of 08/266,828, filed Jun. 27, 1994.

TITLE OF THE INVENTION

The present invention relates to a cassette for a thermal printer, and to a thermal printer in combination with such a cassette.

BACKGROUND OF THE INVENTION

Thermal printers of the type with which the present invention is concerned are known. They operate with a supply of tape arranged to receive an image and a means for transferring image onto the tape. In one form, a tape holding case or cassette holds a supply of image receiving tape and a supply of an image transfer ribbon, the image receiving tape and transfer ribbon being passed in overlap through a printing zone of the printing device. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releasable backing layer by a layer of adhesive. Once an image or message has been printed on the tape, it is desired to cut off that portion of the tape to enable it to be used as a label. For this purpose, it is necessary to remove the releasable backing layer from the upper layer to enable the upper layer to be secured to a surface by means of the adhesive layer. In EP-A-0267890 scissors are used to cut off the tape.

In another type of printing device described for example in EP-A-0322919 (Brother) a tape holding case holds a supply of image receiving tape, a supply of an image transfer ribbon and a supply of adhesive backing tape. The adhesive backing tape has an adhesive layer for contact with the image receiving tape, a substrate layer and a second adhesive layer covered by a releasable backing layer. The characters are printed onto the image receiving tape, which is transparent, as a mirror image.

In a further printing device, described for example in EP-A-0487313 (Esselte Dymo N. V.), a tape holding case holds a supply of image receiving tape and a supply of image transfer ribbon, the image receiving tape having the same construction as described above with reference to EP-A-0267890. In this device, the cassette includes a feed roller which is rotatably mounted and which cooperates with an output roller of a printing device into which the cassette is inserted to feed the image receiving tape out of the printing device after printing has taken place. After the tape has been fed out of the cassette, the printed portion of the tape is cut off by a cutting mechanism located outside the cassette boundary. A similar arrangement is utilised in EP-A-0322919. EP-B-0364305 describes a cassette which has a portion extending beyond the feed roller to provide an anvil for a cutting blade.

In both of these devices, printing is carried out at a print location defined by a thermal print head and a platen against which the print head presses the image receiving tape and image transfer ribbon during printing. The image receiving tape is then fed past the print location by the feed mechanism comprising the feed roller of the cassette and the output roller of the printing device to a cutting mechanism located outside the cassette boundary. Thus, the distance from the print location to the cutting mechanism can be of the order of 23–25 mm and this defines the blank lead portion of a label. It is desirable to reduce the blank lead portion of a label to avoid wasted blank tape and to improve the appearance of labels. Various methods have been proposed to reduce these leaders, all of which methods have involved the use of software control of the way in which the image receiving tape is printed and fed out. In one aspect, the present invention seeks to provide a reduced length of blank tape on a label without the need for complex software control.

Another disadvantage arising from the printing devices of EP-A-0322919, EP-B-0364305 and EP-A-0487313 is that the tape is cut off using a blade which is brought into contact with the tape while it is supported by an anvil. Not only does the action of a blade against an anvil require a significant amount of cutting force to be applied, but it also results in the wear of cutting blades and a need for their replacement during the life of the printer. Another aspect of the present invention provides a solution to these problems.

Finally, the invention seeks to provide a cassette which can be used in a variety of different types of printing devices.

SUMMARY OF THE INVENTION

According to one aspect of the present invention there is provided a tape holding case or cassette for a thermal printer holding at least a supply of image receiving tape and having an outlet through which the image receiving tape can be fed out, the tape holding case having adjacent the outlet a wall portion arranged to support the image receiving tape during cutting and defining a slot underneath the tape into which a blade can travel during cutting.

This arrangement avoids the use of an anvil for cutting. It has been found that the cutting force required to make a cut is significantly reduced, as is the wear of the blade.

Preferably the cassette has no feed roller, and said wall portion is shaped to cooperate with an output roller of a printing device into which the cassette is inserted to feed tape out of the cassette.

Such a cassette is suited for use in a printing device having an output roller. Such a cassette is also suitable for use in a printing device which has no output roller but which instead has a rotatable platen which not only supports the tape during printing but also is driven to feed the tape out of the cassette. The wall portion can be flat or can provide at least one stepped portion over which the tape can be bent during cutting.

The invention also contemplates a printing device with an afore-defined cassette, which printing device has a cutting mechanism located opposite said slot and which comprises a platen rotatable to feed tape out of the cassette, said platen also cooperating with a print head for printing onto the tape. In such a device, no separate output roller is provided and so the distance between the print location (defined between the platen and the print head) and the cutting location (at the slot) can be minimised, thereby to minimise blank leaders on a label.

Preferably the cassette also holds a supply of image transfer ribbon wound between supply and take-up spools.

According to another aspect of the present invention there is provided a cutting apparatus comprising a cutting blade, a support member defining a wall portion arranged to support a tape during cutting and defining a slot underneath the tape into which the blade can travel during cutting. The support member can be part of a cassette as discussed above, or can form part of the printing device itself. Alternatively, it can be a separate component altogether. In any one of these cases, the advantage of cutting a tape into a slot is achieved.

According to a further aspect of the present invention there is provided a tape holding case or cassette for a thermal printer holding at least a supply of image receiving tape and having an outlet through which the image receiving tape can be fed out, the tape holding case having adjacent the outlet a wall portion arranged to support the image receiving tape during cutting and defining at least one stepped portion over which the tape can be bent during cutting.

Such a cassette can be provided in association with the cutting apparatus which comprises a cutting blade mounted for movement towards the tape to cut it and a tape bending member cooperable with the at least one stepped portion to bend the tape.

As discussed in our European Application No. (Page White & Farrer Ref. 73532) when the image receiving tape comprises an image receiving layer secured to a backing layer via adhesive, bending of the tape causes the backing layer to separate from the image receiving layer due to a difference in their resilience. It is particularly advantageous to provide a so-called peel feature as part of the cassette wall. In this case, the cassette wall portion can be shaped to cooperate with an output roller of a printing device to increase its versatility.

For a better understanding of the present invention, and to show how the same may be carried into effect, reference will now be made by way of example to the accompanying drawings.

DESCRIPTION OF THE PREFERRED EMBODIMENT

Figure 1:
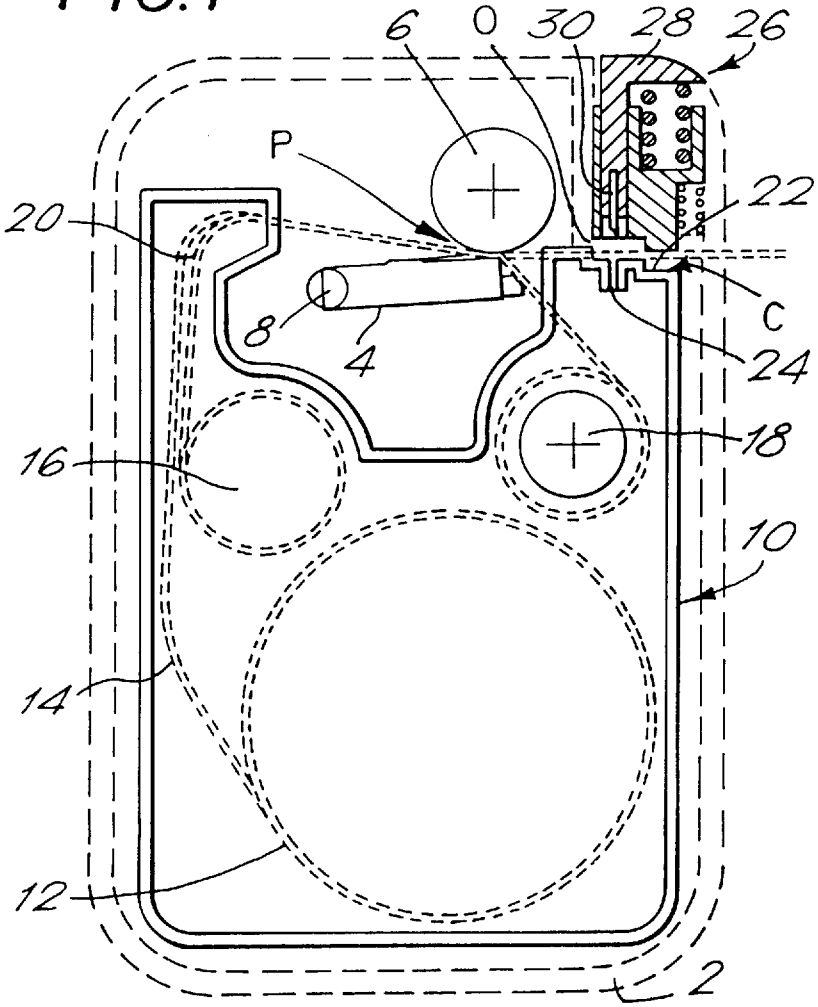

FIG. 1 illustrates in plan view a cassette bay of a printing device. The cassette bay is shown by the dotted line 2. The cassette bay includes a thermal print head 4 and a platen 6 which cooperate to define a print location P in a manner which is known in the art. The print head 4 is pivotable about a pivot point 8 so that it can be brought into contact with the platen 6 for printing and moved away from the platen to enable a cassette to be removed and replaced.

A cassette inserted into the cassette bay 2 is denoted generally by reference numeral 10. The cassette holds a supply spool 12 of image receiving tape 14 which comprises an image receiving layer secured to a backing layer by a layer of adhesive. The image receiving tape 14 is guided by a guide mechanism (which is not shown) through the cassette, out of the cassette through an outlet O, past the print location P to a cutting location C. The cassette 10 also has an ink ribbon supply spool 16 and an ink ribbon take up spool 18. The ink ribbon 20 is guided from the ink ribbon supply spool 16 through the print location P and taken up on the ink ribbon take up spool 18. The image receiving tape 14 passes in overlap with the ink ribbon 20 through the print location P with its image receiving layer in contact with the ink ribbon.

Figure 5:
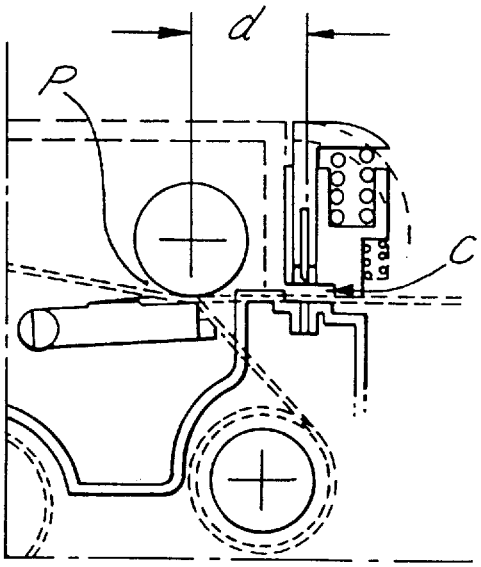
FIG. 5 illustrates how the blank leader of a label is reduced using a cassette of the present invention.

In the printing device illustrated in FIG. 1, the platen 6 is driven so that it rotates to drive the image receiving tape 14 past the print location P during printing. In this way, tape is printed and fed out from the print location P to the cutting location C. In contrast to earlier devices, the cutting location C is provided at a location on a portion of the wall of the cassette 10 which is close to the print location P. As the tape is fed out of the cassette by driving the platen 6, there is no need for a further feed mechanism for the tape and this enables the cutting location C to be closer to the print location P. In the described embodiment, as illustrated in FIG. 5, the distance d between the cutting location and the print location can be 9 mm. The portion of the wall of the cassette 10 where the cutting location C is defined is denoted by reference numeral 22. A slot 24 is defined in this wall portion and the image receiving tape 14 is fed past the print location P to the cutting location C where it is supported by facing wall portions 22*a*, 22*b* on either side of the slot 24 (see FIG. 2).

The printing device includes a cutting mechanism denoted generally by reference numeral 26. This cutting mechanism includes a cutter support member 28 which carries a blade 30. The design of the blade 30 can be seen more clearly in FIG. 4*a* and 4*b*. The blade 30 has a sharpened and angled cutting edge 31. In FIG. 4*a* the dimension x is 6 mm and y is 13 mm. Holes 30*a* are provided to enable the blade 30 to be mounted in the cutter support member. In FIG. 4*b*, the dimension z is 0.70 mm. These dimensions are only exemplary—any suitable blade can be used. The blade 30 cuts the image receiving tape 14 and then enters the slot 24 with the leading part 31*a* of its edge 31 first, rather than bearing against an anvil. The detailed operation of the cutting mechanism is discussed later. However, it is appropriate to point out here that the inventors have found that there are significant advantages to cutting into a slot rather than against an anvil. The amount of force which is required to cut the tape is significantly reduced, and this reduces the cost of the product and the amount of space required for the cutting mechanism. Particularly when considering automated cutting mechanisms, the large amount of force required to cut a tape against an anvil have required complex gearing mechanisms giving a substantial mechanical advantage which has utilised space in the product. Thus, although the cutting mechanism described herein is intended to be manually operated, the concept of cutting into a slot would also have advantages in an automated cutting system.

Furthermore, as the blade cuts into a slot rather than against an anvil, there is no anvil which can wear out and also the life of the blade is increased. This makes it possible to design a cutting mechanism where the blade does not need to be replaced over the life of the printer.

Figure 4:
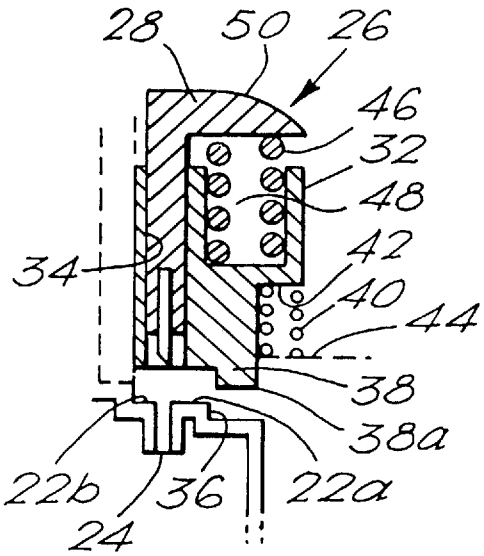
FIG. 4 is a more detailed view of the cutting mechanism.
Figure 3:
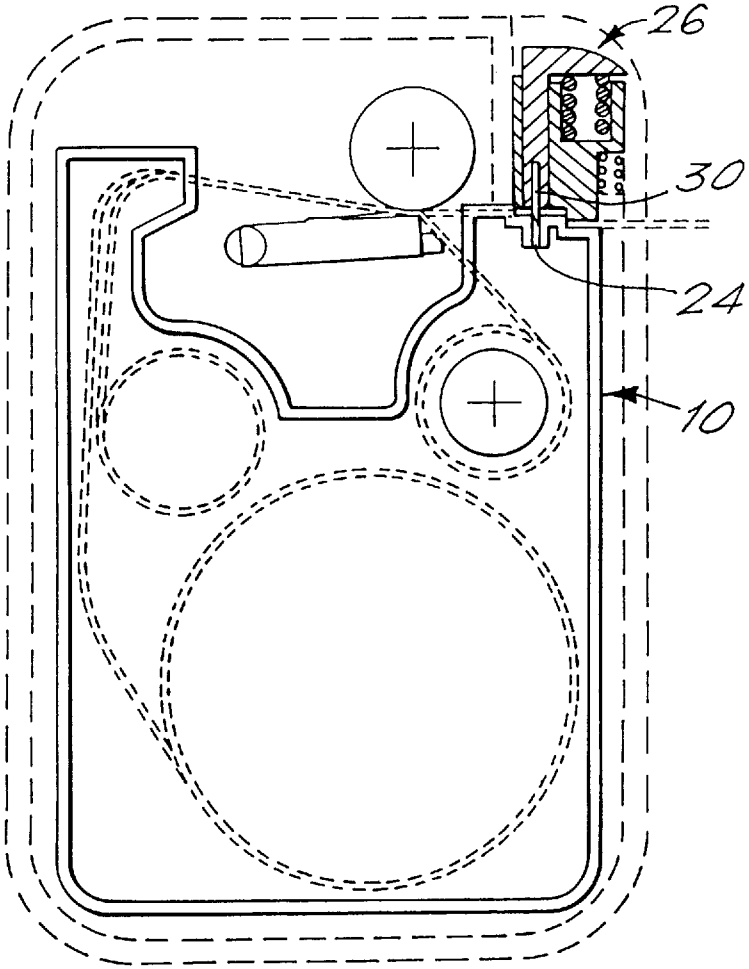
Figure 4A:
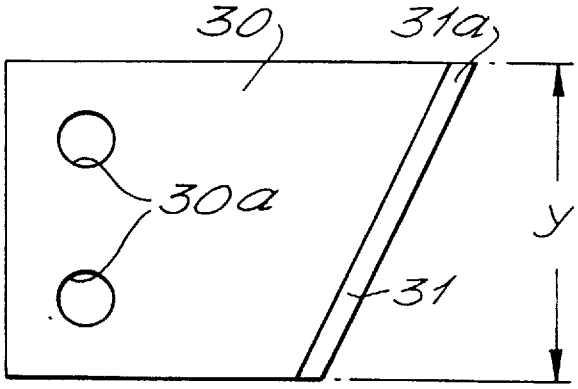
FIGS. 4*a* and 4*b* are a plan view and a side view respectively of a blade.
Figure 4B:
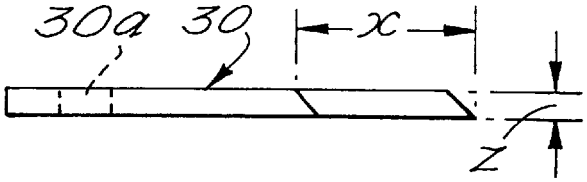

FIG. 4 shows the cutting mechanism 26 in more detail. The cutting mechanism comprises with the cutter support member 28 a tape clamp 32. The cutter support member 28 is mounted for movement within a slot 34 in the tape clamp 32. The portion 22 of the cassette wall 10 defining the cutting location C has adjacent one of the facing surfaces 22*a* a stepped portion 36 which cooperates with a stepped portion 38 in the tape clamp 32 in a manner which will be described more clearly hereinafter. A relatively weak spring 40 is located between a ledge 42 of the tape clamp 32 and a cooperating ledge 44 of the casing 2. A relatively stiff spring 46 is located in a recess 48 of the tape clamp 32 to act against the cutter support member 28. The cutter support member provides a surface which is preferably formed in the shape of a button 50 or the like and which can be depressed by a user using manual force.

Figure 2:
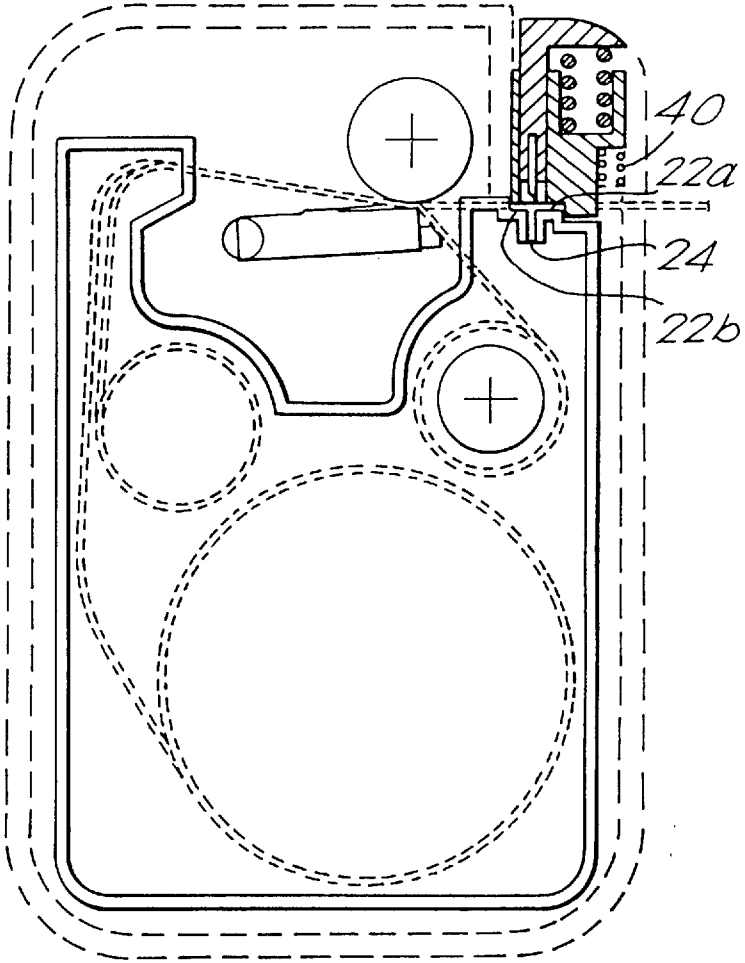
FIGS. 1 to 3 show a printing device with a cassette inserted therein with the cutting mechanism in various stages of operation.

FIG. 1 shows the cutting mechanism in its ready to cut state, that is with the blade 30 spaced from the tape 14 and a lower surface 38*a* of the tape clamp 32 just clear of the tape 14. This permits the leading edge of the tape to be driven past the lower surface 38*a* without excessive risk of catching on it or being deflected by it. When the button 50 is depressed, the relatively weak spring 40 is compressed first against the ledge 44 as shown in FIG. 2 and causes the tape clamp 32 to hold the tape 14 against the surfaces 22*a*, 22*b* thereby clamping the tape 14 against the cassette on both sides of the slot, ensuring that the tape does not move sideways during subsequent cutting and that the cut edge is square. The stepped portion 36 of the cassette wall cooperates with the stepped portion 38 of the tape clamp 32 to bend the tape against the stepped portion 38 of the tape clamp, the backing layer of the tape being adjacent the stepped portion 38. The blade 30 is simultaneously caused to be lowered until it is just in contact with the tape 14. As the button 50 is further depressed, the relatively stiff spring 46 is compressed to cause the cutter support member 28 to move relative to the tape clamp 32 to cause the blade 30 to cut the tape 14. This then provides a portion of tape with a bent portion just behind the cut trailing edge. When the button 50 is released, the cutting mechanism is in its ready-to-cut position under the action of the springs.

In this arrangement, not only does the cutting mechanism have the advantage of providing a cut through the tape into a slot, but it also leaves the trailing edge of the label with a bent part providing a so-called "easy to peel" feature. This is discussed in more detail in our copending European Application No. (Page White & Farrer Ref. 73532) the contents of which are herein incorporated by reference. Briefly, the bend in the tape causes the backing layer to separate from the image receiving layer as a result of their differences in resilience so as to enable a user to peel the backing layer from the image receiving layer more easily.

Figure 6:
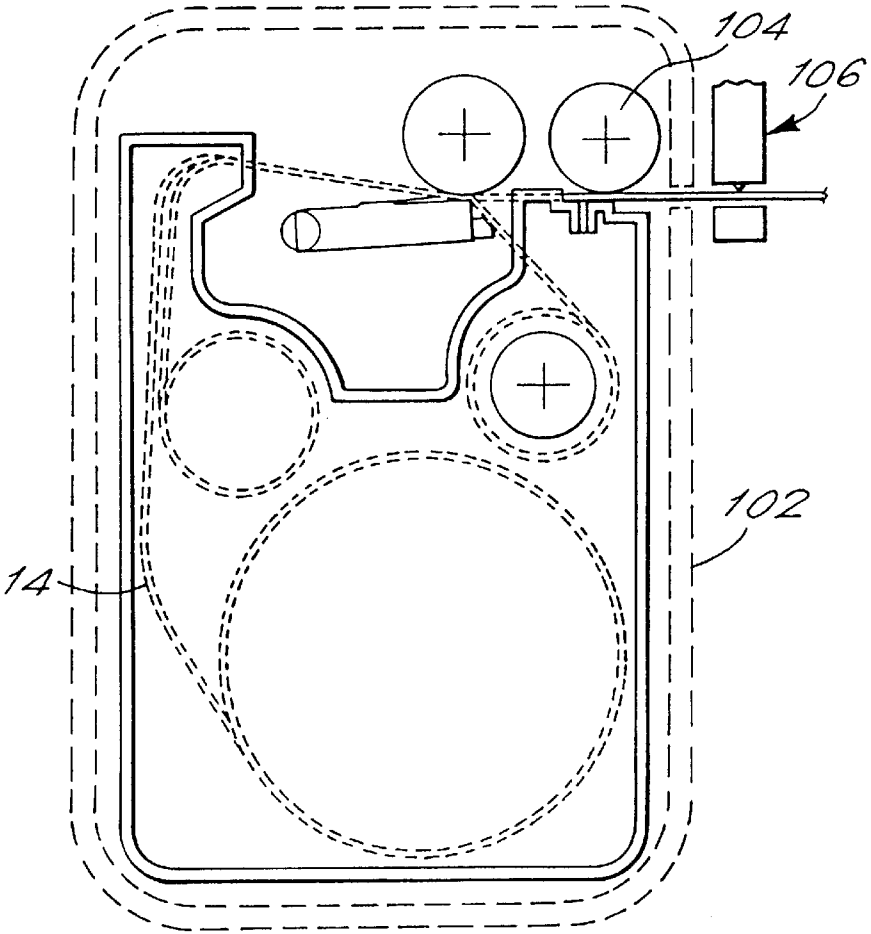
FIG. 6 is a plan view showing the cassette of the invention inserted into an alternative type of printing device.

FIG. 6 illustrates a further advantage of the cassette described herein. In FIG. 6, reference numeral 102 denotes the casing of a cassette bay of a printing device which is different to the printing device described above with reference to FIG. 1 to 5. The printing device in FIG. 6 is of the type discussed above with reference to EP-A-0487313. In this printing device, feeding of the tape 14 is accomplished not by driving the platen 6 but by an output roller such as that denoted by reference numeral 104 in FIG. 6. Conventionally, this output roller 104 cooperates with a feed roller which is arranged in the cassette to pinch the tape between it and the output roller and thereby to enable the tape to be fed out of the cassette. A cutting mechanism which is indicated diagrammatically only in FIG. 6 and designated by reference numeral 106 is located beyond the output location. The cassette described herein can be used in a printing device as illustrated in FIG. 6 even though it does not have a feed roller. The facing surfaces 22*a*, 22*b* cooperate with the output roller 104 to enable tape to be fed out if the output roller 104 is driven. This is possible since the friction between the roller and the tape exceeds the friction between the tape and the facing surface. Thus, the cassette described herein can be used in the printing device described above with reference to FIGS. 1 to 5 or the printing device of FIG. 6, and is thus more versatile than its predecessors.

Furthermore, the cassette provides in its wall a stepped portion 36 which cooperates with a stepped portion 38 in the tape clamp to bend the tape and thus facilitate separation between the backing layer and image receiving layer.

Figure 7:
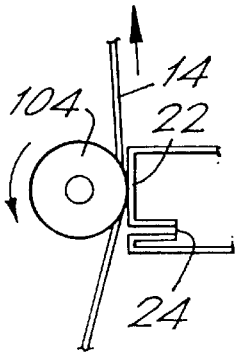
FIG. 7 is a sketch showing cooperation of an output roller of a printing device with the cassette wall.

FIG. 7 illustrates more clearly cooperation of the wall portion 22 of the cassette with an output roller 104 of a printing device as shown in FIG. 6.

Figure 8:
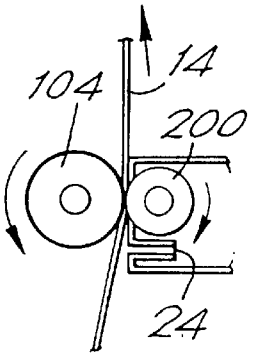
FIG. 8 is a sketch showing cooperation of an output roller of a printing device with an idle roller of the cassette.

Aspects of the invention can also be applied where the cassette includes an idler roller which is intended to cooperate with the output roller 104 of a printing device, and this embodiment is shown in FIG. 8 where reference numeral 200 denotes the idler roller of the cassette.

What is claimed is:

1. A tape holding case for a thermal printer, said tape holding case holding at least a supply of image receiving tape and having an outlet through which the image receiving tape can be fed out, the tape holding case having a wall portion adjacent the outlet, wherein the wall portion is configured and dimensioned to cooperate with an output roller of a printing device into which the tape holding case is inserted, with the wall portion and roller both contacting the tape so that rotation of the roller slides the tape against the wall portion to feed the tape out of the tape holding case.

2. A tape holding case according to claim 1, wherein the wall portion is flat.

3. A tape holding case according to claim 1, wherein said wall portion includes at least one stepped portion over which the tape can be bent during cutting.

4. A tape holding case according to claim 1, which also holds a supply of image transfer ribbon wound between supply and take-up spools.

5. A printing device adapted for cooperation with a tape holding case holding at least a supply of image receiving tape, said tape holding case having an outlet through which the image receiving tape can be fed out and, adjacent the outlet, a wall portion, the printing device comprising:

a cutting mechanism for cutting off a portion of tape;

a cooperating platen and print head for printing onto the tape; and an output roller, wherein the wall portion and the output roller both contact the tape so that rotation of the roller slides the tape against the wall portion to feed the tape out of the tape holding case.

6. A tape holding case for a thermal printer, said tape holding case holding at least a supply of image receiving tape and having an outlet through which the image receiving tape can be fed out, the tape holding case having a wall portion adjacent the outlet, wherein the wall portion is arranged to support the image receiving tape during cutting is configured and dimensioned to cooperate with an output roller of a printing device into which the tape holding case is inserted, with the wall portion and the output roller both contacting the tape so that rotation of the output roller slides the tape against the wall portion to feed the tape out of the tape holding case.

7. A tape holding case for use in combination with a thermal printer, said tape holding case comprising:

a supply of image receiving tape having an image receiving layer and a backing layer;

an outlet through which the image receiving tape can be fed out;

a wall portion positioned adjacent to the outlet;

said thermal printer comprising a print head, a cutting mechanism for cutting off a portion of tape, and an output roller, wherein the wall portion of the tape holding case and the output roller of the printing device both contact the tape so that rotation of the output roller slides the tape against the wall portion to feed the tape out of the tape holding case.

* * * * *